US005449425A

United States Patent [19]

Renard et al.

[11] Patent Number: 5,449,425

[45] Date of Patent: Sep. 12, 1995

[54] METHOD FOR MANUFACTURING A SKI

[75] Inventors: Philippe Renard, Annecy; Jean-Marie Cazaillon, Cran Gevrier; Yves Gagneux, Annecy Le Vieux, all of France

[73] Assignee: Salomon S.A., Metz-Tessy, France

[21] Appl. No.: 99,537

[22] Filed: Jul. 30, 1993

[30] Foreign Application Priority Data

Jul. 31, 1992 [FR] France ..... 92 09735

[51] Int. Cl.[6] ..... B29C 67/00; B32B 5/20

[52] U.S. Cl. ..... 156/78; 156/79; 156/213; 156/242; 156/245; 264/46.5; 264/46.6

[58] Field of Search ..... 156/78, 79, 213, 242, 156/245, 212, 216, 217; 280/610; 264/46.5, 46.6

[56] References Cited

U.S. PATENT DOCUMENTS

| | | | |
|---|---|---|---|
| 3,771,805 | 11/1973 | Ishida | 280/610 |
| 4,146,251 | 3/1979 | Tanahashi | 280/610 |
| 4,697,821 | 10/1987 | Hayashi et al. | 280/610 |
| 4,731,038 | 3/1988 | Hancock et al. | 280/610 |
| 4,953,885 | 9/1990 | Comert et al. | 280/610 |
| 4,973,371 | 11/1990 | Parker | 156/79 |
| 4,993,740 | 2/1991 | Recher et al. | 280/610 |
| 5,057,170 | 10/1991 | Legrand et al. . | |
| 5,171,509 | 12/1992 | Lemasson . | |
| 5,173,226 | 12/1992 | Cazaillon et al. . | |
| 5,183,618 | 2/1993 | Pascal et al. | 280/610 |
| 5,186,777 | 2/1993 | Perenon et al. . | |

FOREIGN PATENT DOCUMENTS

| | | |
|---|---|---|
| 0428886 | 5/1991 | European Pat. Off. . |
| 0428887 | 5/1991 | European Pat. Off. . |
| 0429851 | 6/1991 | European Pat. Off. . |
| 0430824 | 6/1991 | European Pat. Off. . |
| 0442262 | 8/1991 | European Pat. Off. . |
| 2627700 | 9/1989 | France . |

*Primary Examiner*—Michael W. Ball
*Assistant Examiner*—Richard Crispino
*Attorney, Agent, or Firm*—Sandler, Greenblum & Bernstein

[57] ABSTRACT

A manufacturing method of a ski which includes a first preparation step of a solid core made of synthetic foam and a second assembly step of the core with the various component elements of the ski. The first step includes injecting or pouring in a mold having the final shape of the core to be obtained, the components of a hardenable and expandable foam and during which a solid adhesive film having good adhesive properties with the foam as well as with the elements adapted to enter into contact during the second assembly step, is located against the walls of the mold.

26 Claims, 7 Drawing Sheets

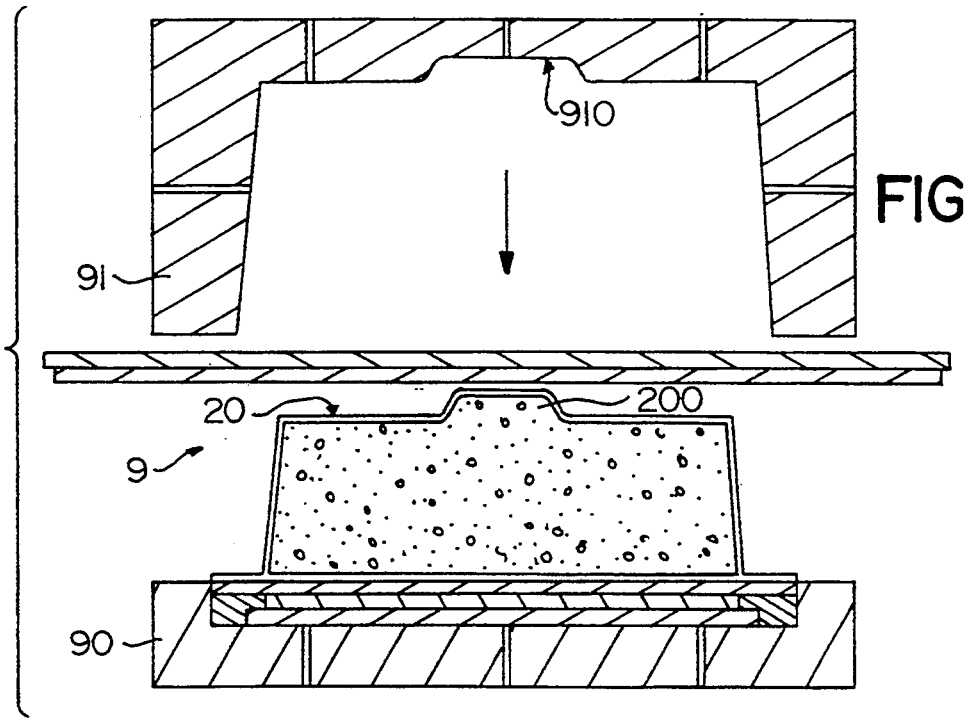
FIG. 15
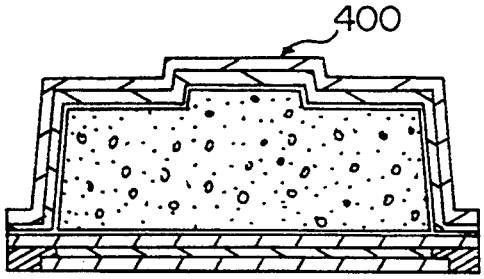
FIG. 16
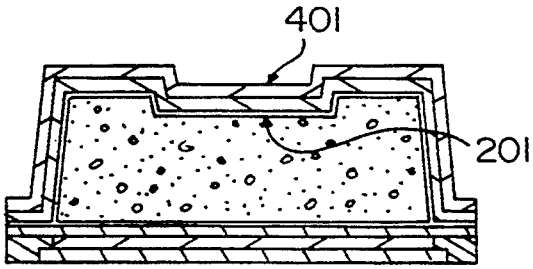
FIG. 17
FIG. 18
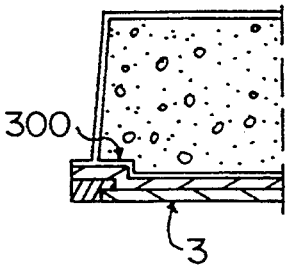
FIG. 19
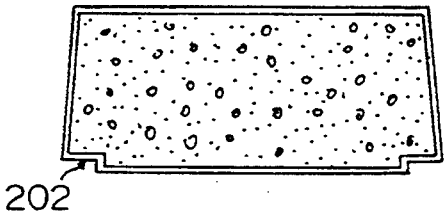

METHOD FOR MANUFACTURING A SKI

BACKGROUND OF THE INVENTION

1. Field of the Invention

The present invention is related to a manufacturing method of skis used for winter sports and adapted to slide on snow and ice, such as alpine skis, mono-skis, and snowboards.

2. Discussion of Background and Relevant Information

Currently known skis generally have a composite structure in which different materials are combined in such a way that each of them cooperates in the structure in an optimal manner, in view of the distribution of mechanical stresses. Thus, the structure generally comprises peripheral decorative and protective elements, forming the upper surface and the lateral surfaces of the ski, internal resistance elements or resistance blades, constituted of a material having substantial mechanical resistance and substantial stiffness. The structure also comprises filler elements such as a core having an alveolar structure, a sliding sole forming the lower surface of the ski and ensuring good sliding on snow, and metallic running edges forming the lower edges of the ski.

In order to obtain the appropriate physical characteristics, modern ski manufacturing techniques use of very diverse materials. For example the sliding soles are generally made of polyethylene, the alveolar cores are made of synthetic foam, the running edges are made of steel, the upper surfaces of the ski are made of thermoplastic films, the resistance blades are metallic or fiber reinforced resin plates.

A ski is subject to severe mechanical stresses, requiring a good adherence between the various materials constituting the structure. In traditional ski manufacturing techniques, the cores are prefabricated in their definitive configuration by machining. They are then subjected to a surface treatment by sanding or punching so as to be able to adhere with the adhesive constituting the matrix of the internal resistance elements, generally of the epoxy type. The assembly of the core with the other elements of the ski is generally done during a later molding step.

The core of a ski is an essential element because it contributes to rigidity in flexion and ensures a filling of the gaps between the various upper, lower and lateral internal resistance elements. The shapes of modern skis have also changed considerably to enable an improvement in the quality of behavior, sliding, or simply an improvement in aesthetic characteristics of view. This is how, skis having inclined, convex or concave lateral edges have appeared, or even skis having corrugations on their upper surface, etc. Thus, the shape of the cores has changed with these new shapes of skis and traditional manufacturing methods comprising machining and surface preparation steps have now become ill-adapted, expensive and complex. In addition, their implementation also leads to numerous problems. In particular, the machining step destroys the fine surface layer of greater density of the synthetic cores (known as the "skin" of the core by specialists). Also, the geometry cannot be reproduced from one core to another.

SUMMARY OF THE INVENTION

It is an object of the present invention to overcome the disadvantages of known methods, by proposing a new method enabling one to obtain, in a minimum number of steps, on the one hand, the manufacture of the core without a surface preparation operation, and on the other hand, the positioning and assembly of all the elements around the core to obtain the ski.

According to the invention, all the geometries of the core can be obtained without difficulty and with an excellent degree of reproduction.

According to another object of the invention, the adherence qualities of the core on the other elements of the ski can be easily adapted in accordance with the nature of such elements.

According to another object of the invention, the prefabricated core is easily manipulated and can be stocked before being used.

To obtain these objects as well as others, the method of the invention comprises a first preparation or stage of a solid core made of synthetic foam and a second assembly step of the core with the different elements constituting the ski. The first step includes injecting or pouring in a mold having the final shape of the core to be obtained, the components of a hardenable and expandable foam. During this step, a solid adhesive film having good adhesive properties with the foam as well as with the elements adapted to enter into contact during the second assembly step or stage, is located between the walls of said mold.

The second assembly step or stage comprises the following series of steps:

- in the first half of a second mold, the component elements of a first lower sub-assembly comprising at least one sliding sole and the lateral metallic running edges are arranged,
- the lower surface of the core formed during the first step is applied on this first sub-assembly,
- a second upper sub-assembly adapted to cover, during the later molding operation, the upper surface and the lateral surfaces of the core is arranged on the core; said sub-assembly including at least one decorative and protective layer,
- the actual molding step is obtained by using the core to deform the second upper sub-assembly within the second half of the mold.

In a first embodiment, the first step or stage includes the following series of steps:

- a closed tubular compartment constituted by solid film is obtained in the inner space of the mold whose shape corresponds to that of the core to be obtained,
- injection or pouring in said tubular compartment thus formed is undertaken, the components of the foam that expand in the inner space of the mold apply the solid film against the walls of the mold,
- one then proceeds with the de-molding of the core thus formed.

In a second embodiment, the first step or stage comprises the following series of steps:

- in the inner cavity arranged in the lower shell of the mold, a first film is arranged,
- the components of the foam are poured inside said cavity thus covered by the film,
- before the total or partial expansion of the foam, the mold is closed by arranging the lower shell on the upper shell on which a second film has been previously arranged under tension,
- after expansion of the foam inside the mold, the core thus formed is de-molded.

According to a variation of the invention, the second assembly step or stage can be substantially different and includes the following series of steps:

in the first half of the second mold, the component elements of a first lower sub-assembly is arranged, the sub-assembly including at least:
one sliding sole,
and lateral metallic running edges.

the lower surface of the core formed during the first step is applied on such first sub-assembly, a second sub-assembly preformed in a first geometric configuration during a separate previous operation is arranged on the core, the definitive forming operation of the sub-assembly and the actual assembly by the core with each sub-assembly is undertaken after having closed the second half of the mold on the first half.

The invention is also related to the core formed as per the first step of the embodiment and used in the second assembly step.

The ski according to the present invention has a cap structure by virtue of the upper sub-assembly forming the upper ski surface and extending downwardly to form opposite lateral sides of the ski.

BRIEF DESCRIPTION OF THE DRAWINGS

Other objects, characteristics and advantages of the present invention will become clearer upon reading the description of the preferred embodiments that follow, described with reference to the annexed drawings, wherein:

FIGS. 14–16 illustrate an embodiment of the method as per a variation;

FIG. 17 is a view as per a variation of FIG. 16;

FIG. 18 is a sectional view of a core according to a variation of the invention;

FIG. 19 shows a detail of the lower sub-assembly on which is positioned the core of FIG. 18 from a variation of FIG. 4;

DETAILED DESCRIPTION OF THE PREFERRED EMBODIMENTS

Figure 1:
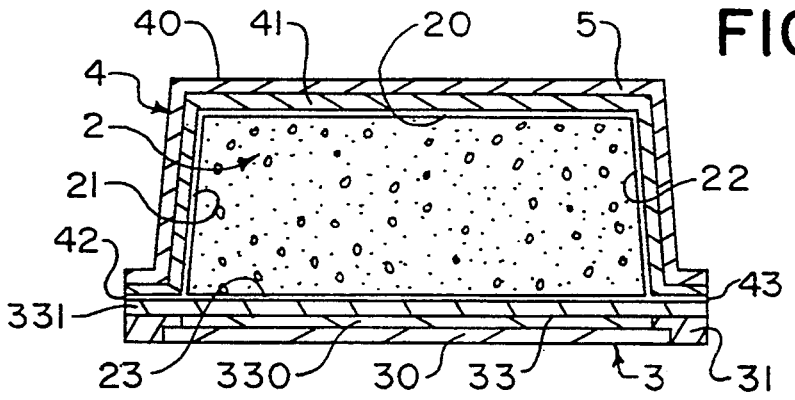
FIG. 1 is a sectional view of the ski obtained as per the invention.

FIG. 1 represents, in a transverse section, a ski 1 obtained as per the method of the invention. It is constituted of three main portions which are: a core 2, a first lower sub-assembly 3 and a second upper sub-assembly or shell 4 covering core 2.

The lower sub-assembly 3 comprises a sliding sole 30 made of polyethylene, for example, lateral metallic running edges 31 and a lower internal mechanical resistance element 33, constituted by one or several reinforcement layers 330–331 made of a composite or metallic material, such as an aluminum alloy, for example.

The upper sub-assembly 4 comprises one or several decorative and protective layers 40 generally made of a thermoplastic material capable of being constituted by a polyurethane, a polycarbonate, a polyamide, or a polyamide copolymer or other. The upper sub-assembly 4 can also comprise an upper internal mechanical resistance element 41 constituted by one or several reinforcement layers. The upper sub-assembly 4 constitutes a shell by covering the upper surface 20 as well as the two lateral surfaces 21, 22 of core 2.

The core is comprised of an injected synthetic thermohardenable foam and is surrounded by a polymer-based adhesive film 5, obtaining the adhesion between the core and the elements in contact with it, and especially the lower mechanical resistance elements 33 and the upper mechanical resistance elements 41. The film can extend beyond each side of lower surface 23 of the core to ensure the affixation of the edges 42, 43 of the upper sub-assembly 4 with the lower sub-assembly 3.

One of the embodiments of the method as per the invention in order to obtain such a ski will be described hereinafter with reference to FIGS. 2–6.

Figure 2:
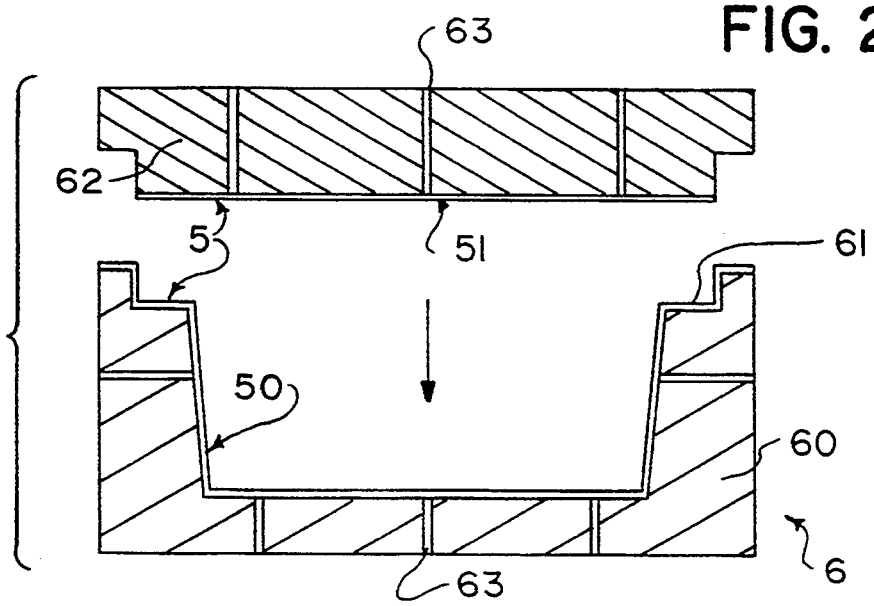
FIGS. 2–4 illustrate the successive operations of preparation of the core, implemented in the first step of the method of the invention as per a first embodiment.
Figure 3:
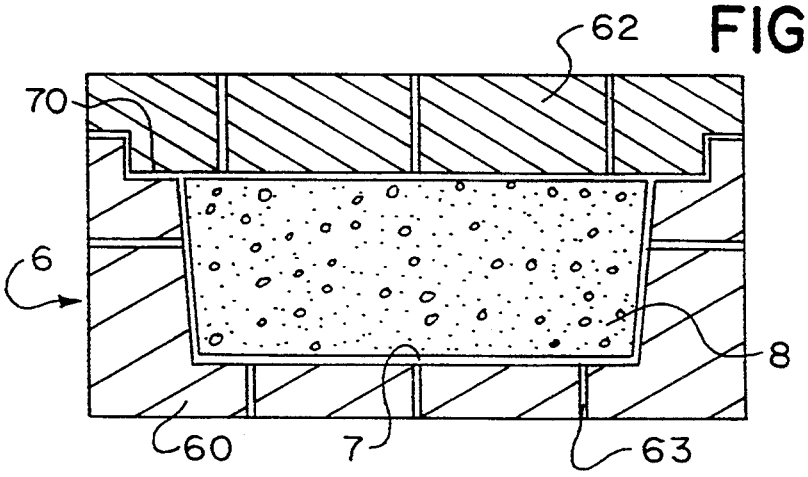
Figure 4:
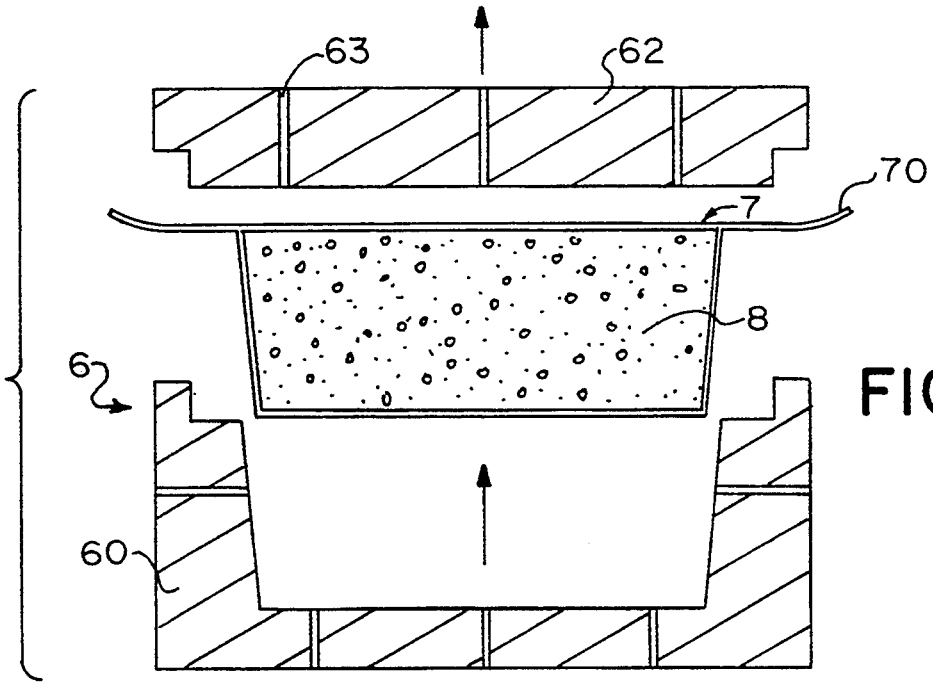

FIGS. 2–4 represent a first preparation step of the solid core made of synthetic foam as per a first embodiment. For this, a mold 6 having the shape and dimensions of the core 2 to be obtained is provided. The first operation consists of obtaining, in such mold, a closed tubular compartment constituted by a solid and polymer-based adhesive film 5. For this, in the inner cavity arranged in the lower shell 60 of mold 6, a first film 50 is arranged, such film exceeding the plane of joint 61 on either side. A second film 51 is located under tension on the wall of upper shell 62 of the mold; the second film also exceeds the plane of joint 61 on either side. The mold is closed; the lateral ends of each film being pinched against one another in the plane of joint 61 to form a seam 70.

During a second operation illustrated in FIG. 3, one obtains low pressure injection or gravity pouring of the components of a hardenable foam such as a polyurethane foam, a polyuric foam, or a phenolic foam, within the tubular compartment 7 thus formed. During its expansion, foam 8 pushes back the tubular membrane which becomes perfectly adapted to the walls of the mold. One then proceeds with the de-molding of the core.

Preferably, the foams used have a group cross-linking polyol content which is greater than or equal to 30% by mass of the total polyol content. This chemical characteristic confers to the foam an improvement of its resistance properties during heat compression; these properties are particularly desirable in the implementation of the method as per the invention. The foams used can also be reinforced with short glass fibers. The fiber content is on the order of 0–30% by mass with respect to the total mass of the mixture.

During the entire manufacturing step of the core, the mold is heated to a temperature between approximately 30° and 80° C. The exothermy of the cross-linking reaction of the foam is greater at 100° C. and can lead to an increase in the temperature of the mold in the range of 20°–30° C., during a few minutes. At these temperatures, the adhesion of the foam on the membrane is perfectly obtained. De-molding is also undertaken while the mold is heated.

Figure 5:
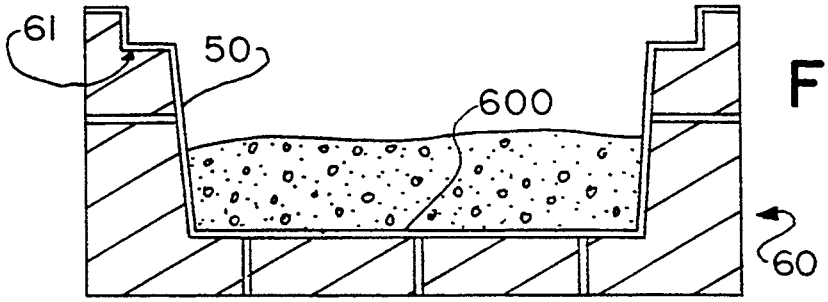
FIGS. 5 and 6 illustrate the successive preparation operations of the core, implemented in a first step of the method as per a variation of the invention.
Figure 6:
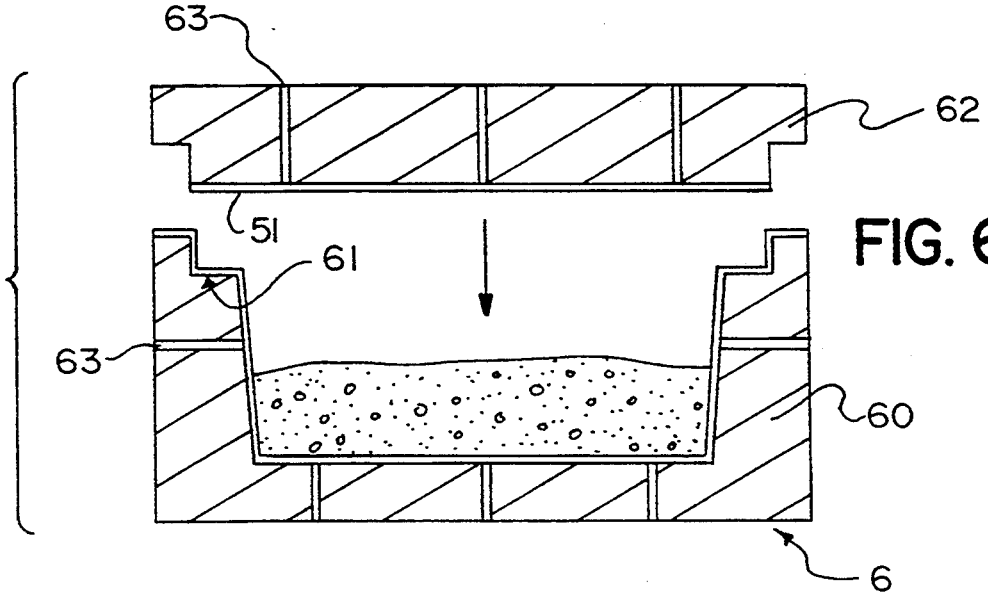

The first preparation step of the core can be implemented as per a variation illustrated in FIGS. 5 and 6. Indeed, one may ensure that the closed tubular compartment 7 described previously is only provided until after having previously obtained the pouring of the components of the hardenable foam in one of the two shells of the mold. For this, one operates in the following manner:

- a first film 50 exceeding the plane of the joint 61 of the mold on either side is located in the inner cavity 600 arranged in the lower shell 60 of mold 6,
- the components of the foam are then poured inside cavity 600,
- before the total or partial expansion deriving from the reaction of the components to each other, the mold is closed. For this, the upper shell 62, on which a second film 51 has previously been arranged under tension, is applied on the lower shell 60. One thus forms the tubular compartment constituted by films 50, 51,
- after closure of the mold, the components react "in situ" causing expansion of the foam which then adheres against the tubular compartment.

Differently from the embodiment of FIGS. 2–4, in this variation the implementation of the pouring must be done manually. It is generally done by an operator who uses a pouring pistol connected to a low pressure pump, such pump being itself connected to the various component vats.

In each embodiment described previously, the positioning and maintenance of films 50, 51 on the walls of the mold is facilitated if one creates a depression between the film and the walls of the mold by virtue of openings 63 provided through the mold and connected to a vacuum pump.

Figure 7:
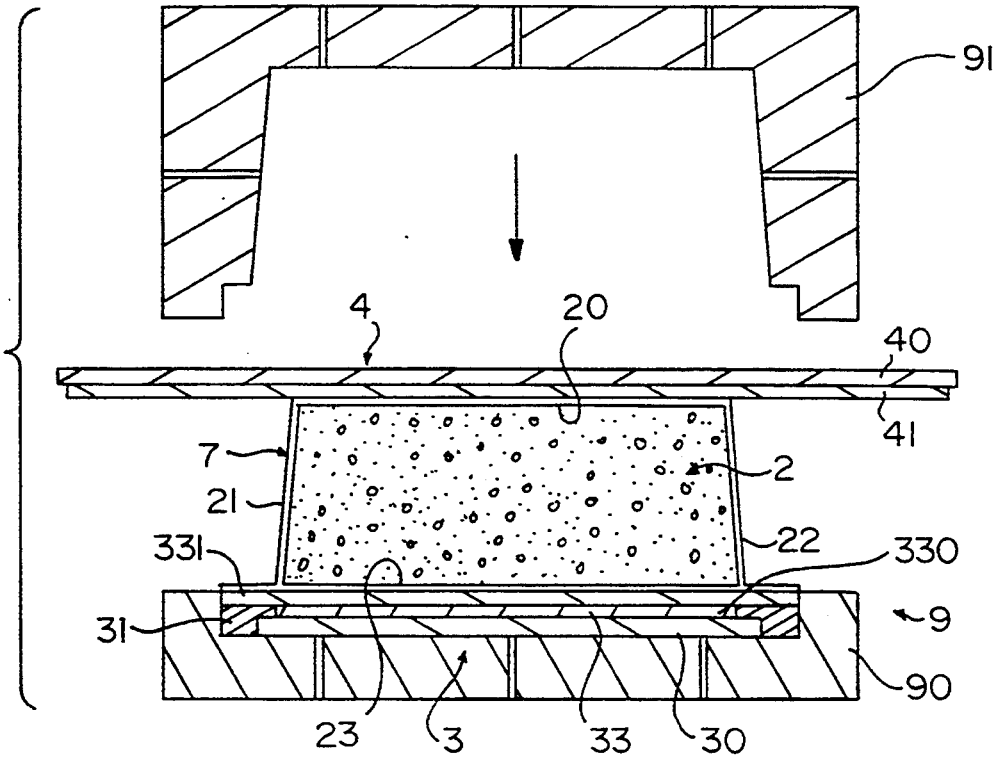
FIGS. 7 and 8 illustrate the operations of assembly of the core with the component elements of the ski, implemented in a second step of the method as per the invention.
Figure 8:
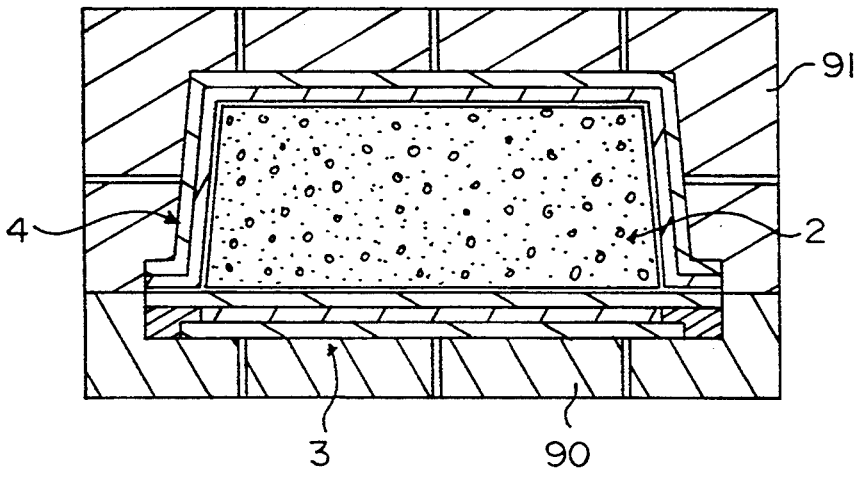

FIGS. 7 and 8 illustrate a special embodiment of the second assembly step of the core 2 with the various component elements of the ski. For this, one provides a second mold 9 made of two portions 90, 91 and whose shape and dimensions correspond to that of the ski that one wishes to obtain. In a first operation, the component elements of lower sub-assembly 3 are located in the lower portion 90 of mold 9. Such sub-assembly comprises a sliding sole 30 made of polyethylene, lateral running edges 31 made of steel, and a lower mechanical resistance element 33 constituted by two reinforcement layers 330, 331. The reinforcement layers can be formed of textile webs made of glass or carbon fibers pre-impregnated with thermohardenable or thermoplastic resin, for example. One can also foresee using textile webs having a matrix of pre-polymerized, thermohardenable resin or even metallic blades made of steel or aluminum.

The component elements of the lower sub-assembly 3 can be assembled and affixed to each other before their arrangement in the mold. But one can provide that the molding operation enables the affixation of such elements to each other, and in particular, the reinforcement layers on the sliding sole and the running edges.

In some cases, it may be necessary to locate an adhesive film between the elements to be glued in a later molding step. Thus, the use of fiber layers and pre-polymerized matrices or metallic blades to constitute the lower mechanical resistance element necessitates the use of adhesive film between each layer and between the sliding layer 30 and the lower reinforcement layer 330.

Secondly, the core 2 is located in the first portion of mold 9 in such a way that its lower surface 23 rests on the lower sub-assembly 3. One then arranges on the upper surface 20 the component elements of the second upper sub-assembly 4. In the case of FIG. 5, the sub-assembly is arranged in a planar configuration and can be maintained centered by any adequate means.

The upper sub-assembly 4 is obtained by stacking one or several layers of at least one protective and decorative layer 40. This layer is adapted to form the top of the ski. It is made of a thermoplastic material such as polyurethane, polyamide, PA 11, PA 12, PA 6, PA 6/6 or other styrenes of the ABS-SANtype, polystyrene, styrenic block copolymer, or other, polypropylene, polycarbonate, acrylic material, polyester of the PET or PBT type, possibly modified. One can also provide that the top be constituted by several layers of the materials cited, especially when the top is decorated by sublimation and must thus comprise a lower revealing opaque layer for the decor and an upper transparent layer bearing the decor. The top is offset in such a way that it covers the upper surface 20 and the lateral surfaces 21, 22 of core 2.

The upper sub-assembly also comprises a mechanical resistance element 41 comprising one or several reinforcement layers. One can especially use textile reinforcement webs made of woven or non-woven glass, carbon polyethylene, Kevlar, or liquid crystal polymer (LCP) fibers, impregnated with a moist or non-tacky thermohardenable resin, in a non-polymerized state, selected from the group constituted by polyester, epoxy and polyurethane or a thermoplastic resin selected from the group constituted by polyamides, polycarbonates, PEI (Polyether Imide), PPS, polypropylenes, and LCP. In this case, the reinforcement layer can also cover the core to form, after cross-linking, a mechanical resistance shell in direct support on the running edges of the ski. One can also provide for the reinforcement of the upper sub-assembly by simple metallic blades or fiber reinforcements having a matrix of cross-linked resin and having substantially the same width as that of the upper surface 20 of the core.

After arrangement of the upper sub-assembly 4, the second upper portion 91 of the mold comprising the imprint of the external shape of the ski to be obtained, is brought closer to the first lower portion 90 for closure. Core 2 is used to deform the upper sub-assembly 4 which is applied against the walls of the imprint of the upper portion of the mold.

In some cases, it can be useful to soften some layers of this sub-assembly so that it can be easily deformed thereafter. This temperature adaptation can be done in various manners. One can separately and previously heat the sub-assembly by infrared radiation, for example. But one can also, after previously heating the mold 9, place the upper portion 91 of the mold against the upper sub-assembly and it is the heat of the mold transmitted by conduction or radiation which softens said sub-assembly to enable its deformation.

After complete closure of the mold, a temperature of approximately 100°–160° C. is maintained during 3–15 minutes to enable the cross-linking of the pre-impregnated materials and the adhesion of adhesive film 5 on the elements surrounding core 2. After hardening, the ski can be taken out of the mold in its final state.

The membranes forming the tubular element 7 are provided as a film made of a material selected for its adhesive properties with, on the one hand, the foam constituting the core, and on the other hand, the walls of the peripheral elements against which the membrane must be applied and adhered.

One can advantageously use polyurethane films, copolyamide film, ABS (Acrylonitrile Butadiene Styrene) films, ethylene or modified EVA copolymers. The films can have a thickness of a few hundredths to a few tenths of a millimeter, advantageously from 1–10 tenths of a millimeter.

Figure 9:
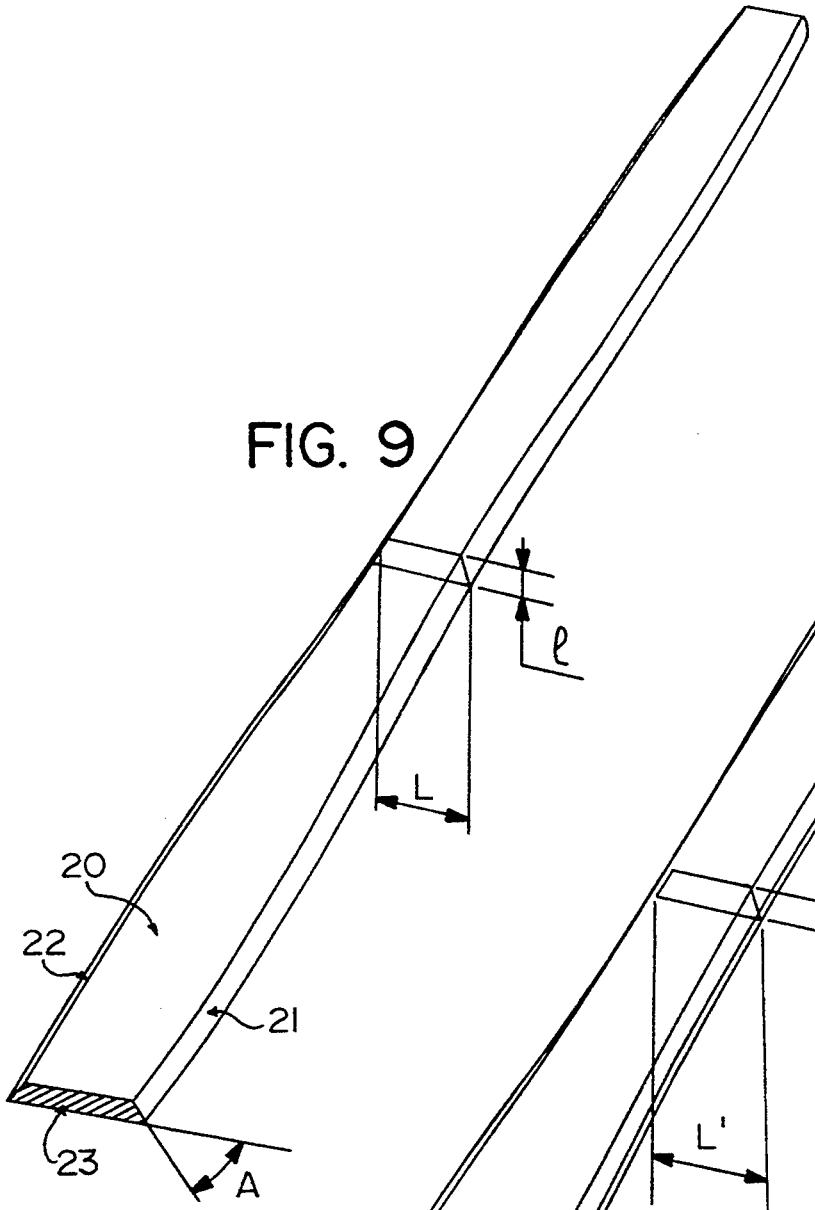
FIG. 9 is a perspective view of the core as per a special embodiment.

FIG. 9 shows an example of a complex core shape obtainable as per the method. The distance l between the upper surface 20 and the lower surface 23 of the core can vary to confer a variable thickness to the ski. Similarly, width L of the lower surface 23 can be variable width to confer to the ski its lateral line. Finally, the lateral surfaces 21, 22 can be inclined with respect to the lower surface 23 by an angle A variable along the core to obtain, in the same way, lateral inclined edges on the finished ski.

Figure 10:
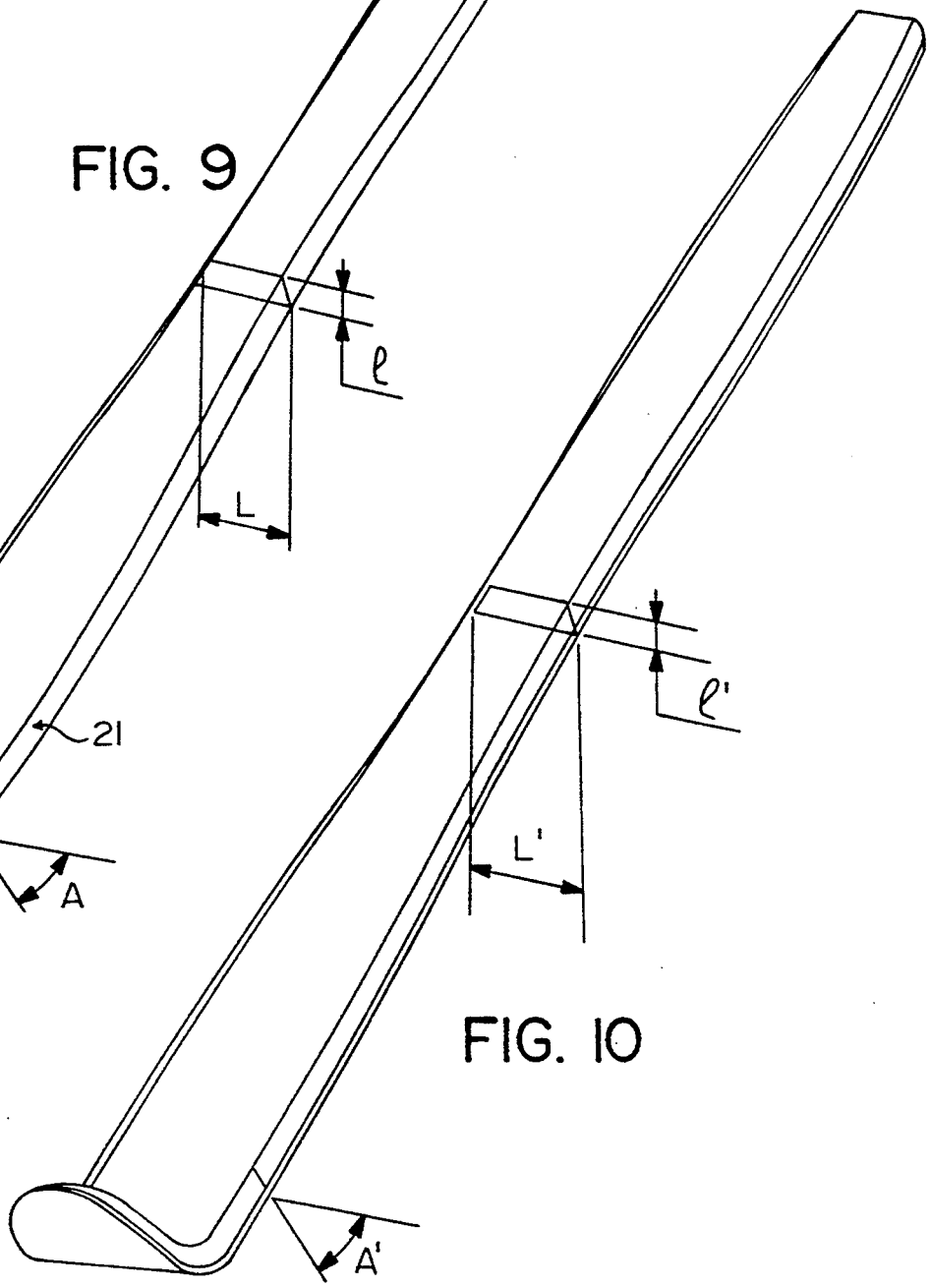
FIG. 10 is a perspective view of an example of a finished ski using the core of FIG. 9.

FIG. 10 shows a ski obtained from such a core where the parameters l', L', A' of the ski correspond to l, L, and A of the core and vary along the ski.

Figure 11:
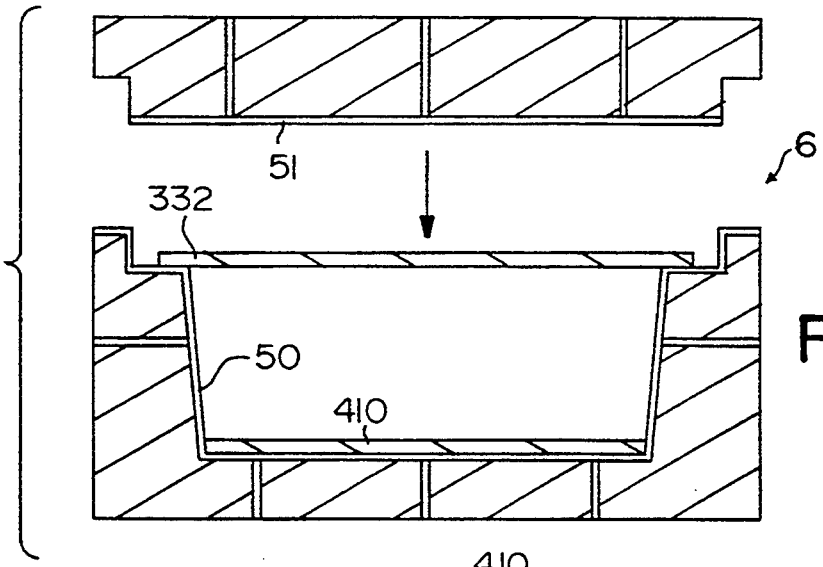
FIGS. 11 and 12 illustrate a variation of the embodiment of the core as per the invention.
Figure 12:
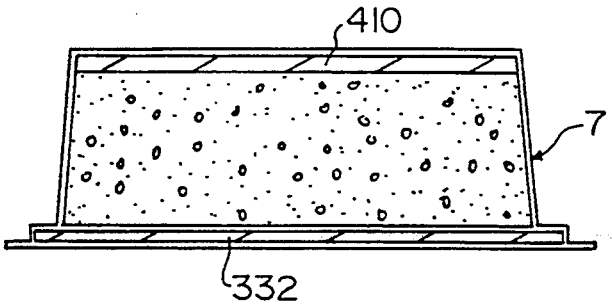

FIGS. 11 and 12 show a special embodiment of the core comprising upper mechanical resistance elements 410 and/or lower mechanical resistance elements 332. During a first preparation step of the core, such elements are inserted inside mold 6 after arrangement of films 50, 51 on the walls of the mold and before the injection or pouring operation of the foam. The elements can be constituted by reinforcement layers of the same type as those described previously. They can complete the reinforcement of the lower 33 and upper 41 sub-assemblies, or even replace the mechanical resistance sub-assemblies 3, 4 of the ski.

Figure 13:
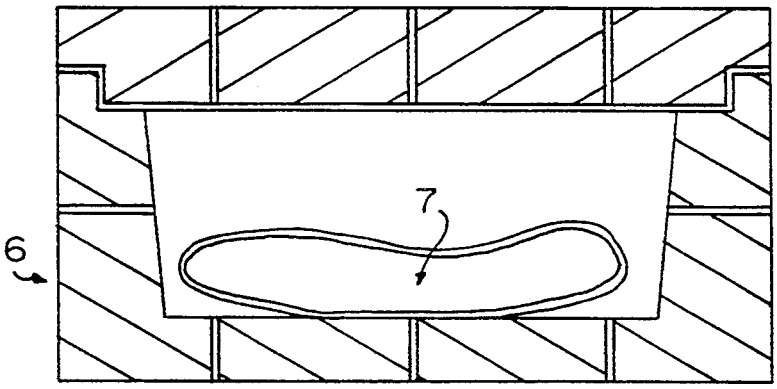
FIG. 13 illustrates a variation of FIG. 1 related to the achievement of a closed tubular compartment.

FIG. 13 is a special embodiment of the invention in which the tubular compartment 7 is provided as from a closed tubular membrane made of a single deformable and extensible element. As shown in FIG. 13, the tubular compartment 7 is formed by having the single deformable and extensible element closed at least along a longitudinal edge, extending longitudinally along the interior of the mold 6. The injection of the foam is obtained in the same way inside the membrane and the injection pressure ensures the extension and application of the membrane against the walls of mold 6.

Figure 14:
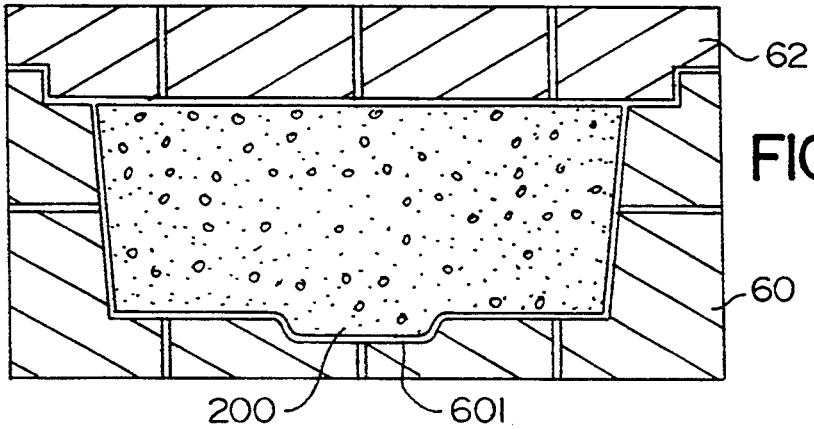

FIGS. 14–16 show an embodiment with a rib 400 on the upper surface of the ski as per the method of the invention. To obtain the rib 400, one must first provide a hollow 601 in the lower shell 60 of the mold 6 which will be filled by the foam during injection of the core. The core thus de-molded, has a rib 200 on its upper surface 20. During the second assembly step (FIG. 15), the rib of the core deforms the upper sub-assembly within a hollow 910 having a complementary shape provided in the upper portion 91 of mold 9 of the ski.

FIG. 17 shows, inversely, the possibility of obtaining, as per the method, a depression 401 on the upper surface of the ski by providing a depression 201 having a dimension which is substantially greater on the core during the implementation of the first injection step.

As can be seen in FIG. 18, the core can comprise, on each lower edge, a groove 202 which can be provided during the implementation of the first step of the method. This groove 202 cooperates with a lateral edge 300 of the lower sub-assembly 3 to enable better retention and centering of the core during the second step of the method (FIG. 19).

Figure 20:
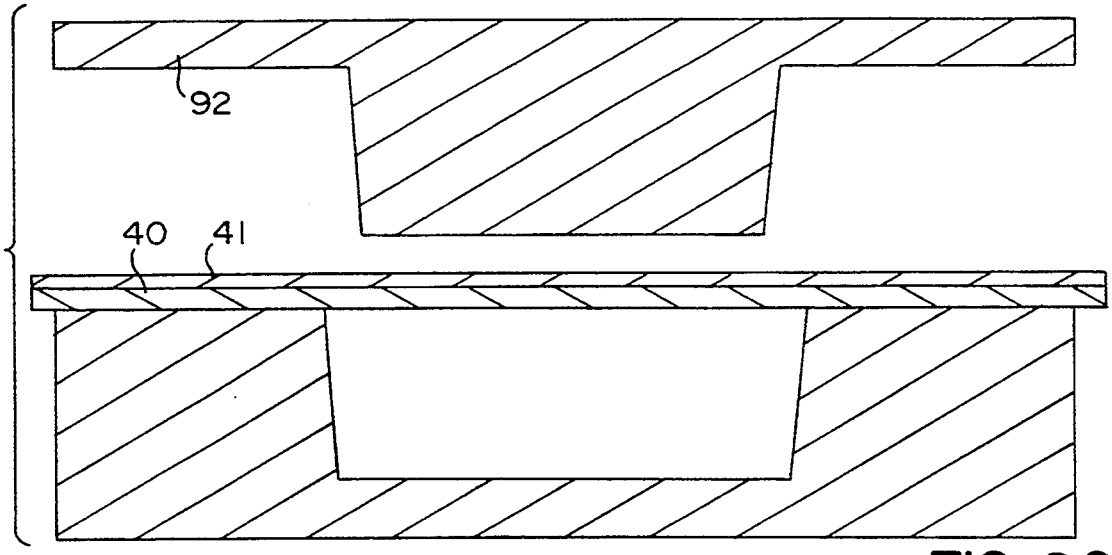
FIGS. 20 and 21 illustrate a variation of the implementation of the second assembly step of the core.
Figure 21:
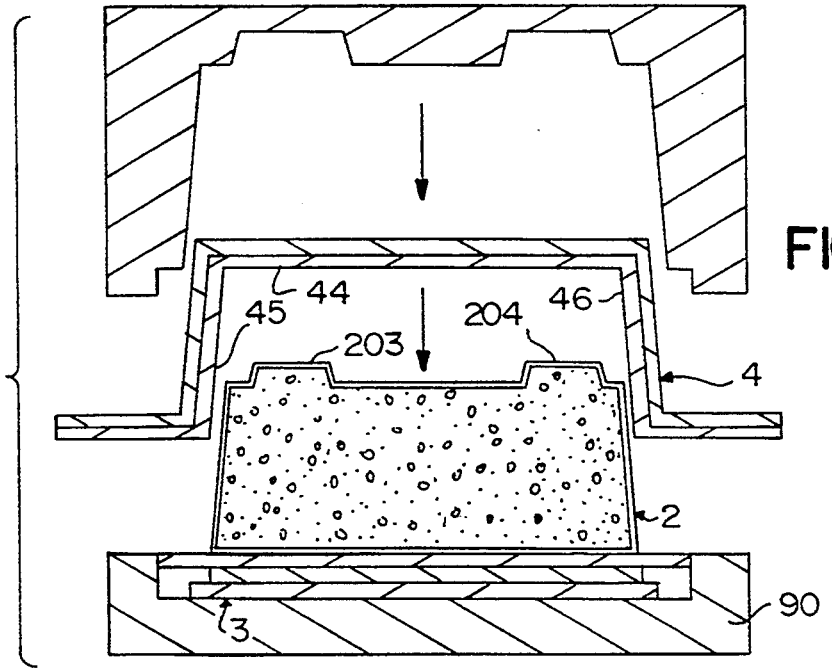

FIGS. 20 and 21 show a variation of the method, and more specifically, of the second assembly step of the core with the component elements of the ski. Thus, one can provide that the second sub-assembly be pre-formed before its introduction in the assembly mold 9, 90, 91. In the case of FIGS. 7 and 8, the upper sub-assembly 4 is located in the second mold 9, 90, 91 in a planar or substantially planar configuration and it is the core 2 which is used to deform the sub-assembly 4 which is applied against the walls of the imprint of the upper portion 91 of the mold.

Figure 22:
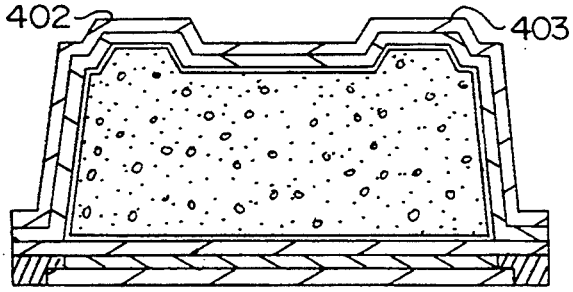
FIG. 22 is a sectional view of the ski obtained by the method as per the variations of FIGS. 20 and 21.

It is the aim of the pre-forming operation to arrange sub-assembly 4 in a geometrical configuration close to that one wishes to finally confer to the ski. For this, one needs, in fact, to obtain a blank shaped like the top of the ski. Thus, this operation consists of pressing the sub-assembly in a mold 92 to give it a first geometrical configuration blank. This operation is done in cold when the reinforcement elements 41 are constituted by a thermohardenable resin based matrix. It can be done in heat when the reinforcement elements are exclusively made of a thermoplastic resin based matrix. Thereafter, the upper sub-assembly 4 pre-formed in this way, is located in the core formed during the first step. The upper surfaces 20 and the lateral surfaces 21, 22 of the core are covered by the internal upper surfaces 44 and the internal lateral surfaces 45, 46 respectively of the pre-formed sub-assembly 4. The actual .definitive forming and assembly operation of the elements is obtained in the second mold 90, 91 (see FIG. 21) by application and addition of heat. It is the shape of the core which confers to the upper sub-assembly its final configuration. In the case illustrated as an example, the core is provided with two lateral ribs 203, 204 which will enable the obtention of two lateral ribs 402, 403 on the top of the ski after de-molding and stripping of the sides of sub-assembly 4 (FIG. 22). Pre-forming is recommended when the final shapes to be obtained are complex and/or very angular.

The instant application is based upon French patent application No. 92.09735 of Jul. 31, 1992, the disclosure of which is hereby expressly incorporated by reference thereto, and the priority of which is hereby claimed.

Naturally, the invention is not limited to the embodiments described and represented as examples, but also comprises all technical equivalents and combinations thereof.

What is claimed is:

1. A ski manufacturing method, said method comprising:

a first stage for preparing a core, said first stage comprising:

positioning a solid adhesive film within a first mold;

putting components of a hardenable and expandable foam into said first mold, said solid adhesive film having good adhesive properties with said foam;

removing a solid core, having a covering of said adhesive film from said first mold, said adhesive film covered solid core having at least an upper surface, a lower surface and a pair of opposite lateral surfaces; and a second stage for assembling a plurality of structural components to said core, said structural components including a first lower ski sub-assembly and a second upper ski sub-assembly, said first lower sub-assembly including at least a sliding sole and lateral running edges, said second upper sub-assembly including at least one decorative and protection layer, said second stage comprising:

positioning said sliding sole and lateral running edges of said first lower sub-assembly in a first part of a second mold;

positioning said lower surface of said solid core, prepared in said first stage, on said first lower sub-assembly;

positioning said second upper sub-assembly on said upper surface of said solid core, said second upper sub-assembly having a width greater than a width of said upper surface of said solid core;

moving a second part of said second mold toward said solid core positioned in said first part of said second mold and, while moving said second part of said second mold, deforming said second upper sub-assembly within said second part of said second mold so that said second upper sub-assembly covers said upper surface of said solid core and at least portions of said opposite lateral surfaces of said solid core by engagement of said second upper sub-assembly with said solid core.

2. A ski manufacturing method according to claim 1, wherein:

said first stage comprises, after said positioning of said solid adhesive film within said first mold and before step of putting components of a hardenable and expandable foam into said mold, forming a tubular compartment constituted by said solid film positioned within said first mold, whereby after said foam is permitted to expand within said first mold and to apply said solid adhesive film against interior walls of said first mold.

3. A ski manufacturing method according to claim 2, wherein:

after said forming a tubular compartment constituted by said solid film, injecting said components of said hardenable and expandable foam into said mold.

4. A ski manufacturing method according to claim 2, wherein:

said first mold comprises a lower shell and an upper shell;

said solid adhesive film comprises a first film portion and a second film portion;

said forming a tubular compartment comprises:

positioning said first film portion in said lower shell of said first mold;

affixing said second film portion on an inner surface of said upper shell of said first mold; and closing said first mold by bringing together said upper shell and said lower shell.

5. A ski manufacturing method according to claim 4, wherein:

said bringing together said upper shell and said lower shell of said first mold forms a mold interior and a mold joint, said mold joint being formed by mutually engaging joint surfaces of said upper shell and said lower shell at least on opposite lateral sides of said first mold;

said positioning said first film portion in said lower shell comprises positioning said first film portion in said lower shell and extending at least on said joint surfaces of said lower shell;

said positioning said second film portion on said inner surface of said upper shell comprises positioning said second film portion on said inner surface of said upper shell and extending at least on said joint surfaces of said upper shell; and said adhesive film covering of said solid core comprising a longitudinally extending seam at opposite lateral sides of said solid core formed by respective portions of said first film and said second film having extended on said joint surfaces of said upper shell and said lower shell.

6. A ski manufacturing method according to claim 2, wherein:

said solid adhesive film comprises a single deformable and extensible film;

said forming a tubular compartment comprises closing said single deformable and extensible film upon itself at least around a longitudinally extending edge.

7. A ski manufacturing method according to claim 1, wherein:

said first mold comprises a lower part and an upper part;

said positioning a solid adhesive film within a first mold comprises positioning a solid adhesive film against an interior surface of said lower part of said first mold and positioning a solid adhesive film against an interior surface of said upper part of said first mold;

said putting components of a hardenable and expandable foam into said mold comprises pouring said components of said hardenable and expandable foam into said lower part of said first mold; and before partial or total expansion of said foam, the method comprises closing said first mold by applying said upper part of said first mold onto said lower part of said first mold.

8. A ski manufacturing method according to claim 7, wherein:

after said positioning of a solid adhesive film within said first mold and before said putting components of a hardenable and expandable foam into said first mold, the method further comprises placing upper and/or lower mechanical resistance elements within said first mold.

9. A ski manufacturing method according to claim 7, wherein:

said first mold comprises a lower shell and an upper shell;

said solid adhesive film comprises a first film portion and a second film portion;

said forming a tubular compartment comprises:

positioning said first film portion in said lower shell of said first mold;

affixing said second film portion on an inner surface of said upper shell of said first mold; and closing said first mold by bringing together said upper shell and said lower shell.

10. A ski manufacturing method according to claim 9, wherein:

said bringing together said upper shell and said lower shell of said first mold forms a mold interior and a mold joint, said mold joint being formed by mutually engaging joint surfaces of said upper shell and said lower shell at least on opposite lateral sides of said first mold;

said positioning said first film portion in said lower shell comprises positioning said first film portion in said lower shell and extending at least on said joint surfaces of said lower shell;

said positioning said second film portion on said inner surface of said upper shell comprises positioning said second film portion on said inner surface of said upper shell and extending at least on said joint surfaces of said upper shell; and said adhesive film covering of said solid core comprising a longitudinally extending seam at opposite lateral sides of said solid core formed by respective portions of said first film and said second film having extended on said joint surfaces of said upper shell and said lower shell.

11. A ski manufacturing method according to claim 1, wherein:

after said positioning of a solid adhesive film within said first mold and before said putting components of a hardenable and expandable foam into said first mold, the method further comprises placing upper and/or lower mechanical resistance elements within said first mold.

12. A ski manufacturing method according to claim 11, wherein:

the second stage comprises, before said positioning said second upper sub-assembly on said upper surface of said solid core, a pre-forming operation, said pre-forming operation comprises forming said second upper sub-assembly in a predetermined geometrical configuration.

13. A ski manufacturing method according to claim 12, wherein:

said pre-forming operation comprises pressing said second upper sub-assembly in a further mold to confer on said second upper sub-assembly an upper portion and opposite lateral portions, said upper portion and opposite lateral portions of said second upper sub-assembly corresponding to respective portions of said core.

14. A ski manufacturing method according to claim 1, wherein:

said solid adhesive film comprises a member selected from the group consisting of polyurethanes, copolyamides, ABS, ethylene and modified EVA copolymers.

15. A ski manufacturing method according to claim 1, wherein:

said first lower sub-assembly comprises a sliding sole and a lower mechanical resistance element constituted by one or more reinforcement layers, said lower mechanical resistance element to be positioned interiorly of the ski from said sliding sole.

16. A ski manufacturing method according to claim 15, wherein:

each of said reinforcement layers comprises a metallic blade or fibers having a cross-linked resin matrix.

17. A ski manufacturing method according to claim 1, wherein:

said second upper sub-assembly comprises a decorative and protective layer and an upper mechanical resistance element constituted by one or more reinforcement layers, said upper mechanical resistance element to be positioned interiorly of the ski from said decorative and protective layer.

18. A ski manufacturing method according to claim 15, wherein:

each of said reinforcement layers comprises a textile web comprised of glass or carbon fibers pre-impregnated with thermohardenable or thermoplastic resin.

19. A ski manufacturing method according to claim 17, wherein:

each of said reinforcement layers comprises a textile web comprised of glass or carbon fibers pre-impregnated with thermohardenable or thermoplastic resin.

20. A ski manufacturing method according to claim 17, wherein:

each of said reinforcement layers comprises a metallic blade or fibers having a cross-linked resin matrix.

21. A ski manufacturing method according to claim 1, wherein:

said first mold comprises a lower part and an upper part;

said lower part comprises a recessed portion in an interior surface for forming a rib on an upper surface of said solid core.

22. A ski manufacturing method according to claim 1, wherein:

said first mold comprises a lower part and an upper part;

said lower part comprises a projecting portion in an interior surface for forming a recess on an upper surface of said solid core.

23. A ski manufacturing method according to claim 1, wherein:

the core is a unitary solid core;

the ski is a cap ski; and said deforming said upper sub-assembly results in the forming of an upper ski surface and opposite lateral ski surfaces.

24. A ski manufacturing method according to claim 1, wherein:

in said first stage, after said putting components of a hardenable and expandable foam into said first mold, the method comprises heating said first mold; and in said second stage, after said moving a second part of said second mold toward said solid core positioned in said first part of said second mold, the method comprises heating said second mold.

25. A ski manufacturing method comprising:

positioning a plurality of structural components in a first part of a mold, said structural components forming a first lower ski sub-assembly including at least a sliding sole and lateral running edges;

positioning a lower surface of a prefabricated synthetic foam solid core on said first lower sub-assembly, said core being covered on all surfaces with a solid adhesive film;

positioning a second upper sub-assembly on said core, said second upper sub-assembly having a width greater than a width of said upper surface of said solid core so that said second upper sub-assembly is adapted to cover an upper surface and opposite lateral surfaces of said core, said second upper sub-assembly comprising at least one decorative and protective layer;

closing said mold by bringing together said first part of said mold and a second part of said mold and, during said closing, deforming said second upper sub-assembly within said second part of said mold by means of said core.

26. A ski manufacturing method according to claim 25, further comprising:

heating said mold after said closing.

* * * * *